US005415220A

United States Patent [19]

Edwards

[11] Patent Number: 5,415,220

[45] Date of Patent: May 16, 1995

[54] DIRECT CHILL CASTING OF ALUMINUM-LITHIUM ALLOYS UNDER SALT COVER

[75] Inventor: H. Marvin Edwards, Richmond, Va.

[73] Assignee: Reynolds Metals Company, Richmond, Va.

[21] Appl. No.: 34,329

[22] Filed: Mar. 22, 1993

[51] Int. Cl.[6] ..... B22D 11/10

[52] U.S. Cl. ..... 164/473; 164/459; 164/123; 164/487

[58] Field of Search ..... 164/473, 472, 487, 459, 164/123

[56] References Cited

U.S. PATENT DOCUMENTS

| | | | |
|---|---|---|---|
| 2,825,947 | 3/1958 | Goss . | |
| 3,318,363 | 5/1967 | Goss . | |
| 3,854,934 | 12/1974 | Dore et al. . | |
| 3,993,477 | 11/1976 | Hess et al. . | |
| 4,290,809 | 9/1981 | Loane, Jr. . | |
| 4,365,993 | 12/1982 | Meredith et al. . | |
| 4,386,764 | 6/1983 | Claxton . | |
| 4,445,849 | 5/1984 | Bouille . | |
| 4,451,287 | 5/1984 | Bauer et al. . | |
| 4,524,819 | 6/1985 | Yoshimura . | |
| 4,582,118 | 4/1986 | Jacoby et al. . | |
| 4,770,697 | 9/1988 | Zurecki | 164/475 |
| 4,808,283 | 2/1989 | Toyoshima et al. | 204/71 |
| 4,973,390 | 11/1990 | Christini et al. | 204/68 |
| 5,057,194 | 10/1991 | Stewart et al. . | |

FOREIGN PATENT DOCUMENTS

| | | |
|---|---|---|
| 2014487 | 8/1979 | United Kingdom . |
| 2129345 | 5/1984 | United Kingdom . |
| 0235926 | 12/1970 | U.S.S.R. . |

OTHER PUBLICATIONS

S. Rao, P. R. Dawson, "A State Of The Art Report On Secondary Aluminum Production Processes With Particular Emphasis On Fluxes And Emission Control", Warren Spring Laboratory, Jun. 1980.

Nair et al., "Technology For Aluminum-Lithium Alloy Production-Ingot Casting Route", Seminar Proceedings: Science & Technology of Al-Ll Alloys, 4-5 Mar. 1989, Hal, Bangalore.

Seshan et al., "Casting Aluminum-Lithium Alloys in Open Atmosphere", Materials & Manufacturing Processes, pp. 109-119 (1990).

*Primary Examiner*—Kuang Y. Lin

*Attorney, Agent, or Firm*—Alan M. Biddison

[57] ABSTRACT

Casting aluminum-lithium based alloys under a salt cover involves forming a molten aluminum-lithium alloy, transferring the molten aluminum-lithium alloy to a casting station, and direct chill casting the aluminum-lithium alloy, wherein a protective molten salt cover comprising a mixture of lithium chloride and potassium chloride is maintained over the aluminum-lithium alloy during the casting process. Formation of the molten aluminum-lithium alloy includes alloying of lithium with aluminum by adding lithium to the salt-covered molten aluminum in a melting vessel. The molten salt may be added to the ingot head during casting. A preferred salt mixture includes 35 to 90 mole % LiCl and 10 to 65 mole % KCl.

18 Claims, 2 Drawing Sheets

DIRECT CHILL CASTING OF ALUMINUM-LITHIUM ALLOYS UNDER SALT COVER

TECHNICAL FIELD

Present invention relates to methods and apparatus for the direct chill casting of aluminum-lithium alloys and, in particular, to direct chill casting wherein the aluminum-lithium alloys are direct chill cast under a protective molten salt cover including lithium and potassium chlorides as components thereof.

BACKGROUND ART

In the aircraft and aerospace industry, it has been generally recognized that one of the most effective ways to reduce the weight of an aircraft is to reduce the density of aluminum alloys used in the aircraft construction. For purposes of reducing the alloy density, aluminum-lithium alloy have been developed by reason of their material properties such as low density, high strength, high fracture toughness and high modulus of elasticity.

However, continuous casting of aluminum-lithium alloys into ingot form by conventional casting processes such as direct chill casting presents problems and disadvantages including lithium burn-off, flaming, smoking and inaccessibility to the melt.

In response to these obstacles alternative direct chill continuous casting processes have been proposed to overcome these deficiencies. In U.S. Pat. No. 4,582,118 to Jacoby et al, a method for continuously casting lithium-containing alloys by a direct chill process has been proposed utilizing a fire retardant atmosphere. These prior art processes are disadvantageous in that they require an extensive and complex array of apparatus components to maintain the continuous casting operation under the fire retardant atmosphere. Moreover, operating costs are increased by the use of fire retardant materials in conjunction with the casting process.

In response to these disadvantages, a need has developed for improved aluminum-lithium continuous casting methods and apparatus which overcome these prior art deficiencies.

In response to this need, the present invention provides a method and apparatus for the direct chill casting of aluminum-lithium alloys wherein the aluminum-lithium alloys are direct chill cast under a protective molten salt flux cover comprising a mixture of lithium and potassium chloride.

In the reclamation of aluminum scrap, it is known to carry out scrap melting operations in a reverberatory or rotary furnace under a cover flux to protect the surface of the molten aluminum from oxidation and to improve the separation of the molten metal from the dross layer which forms above it. U.S. Pat. No. 4,365,993 to Meredith discloses a process for recovering aluminum from lacquer-coated scrap using a solution of a mixture of halide salts, in particular, potassium and sodium chloride. However, this patent is not concerned with the direct chill casting of aluminum-lithium alloys or the problems associated therewith.

SUMMARY OF THE INVENTION

It is accordingly one object of the present invention to provide a method for casting aluminum-lithium-based alloys without the need of an inert atmosphere to prevent oxidation thereof.

It is another object of the present invention to provide a method for melting and casting aluminum-lithium-based alloys under a molten salt cover of potassium and lithium chloride.

It is a further object of the present invention to provide a method for alloying lithium to molten aluminum which has a molten salt cover thereon.

Another object of the present invention is to provide a method for forming a molten aluminum-lithium alloy, transferring the molten aluminum-lithium alloy through a transfer trough to a direct chill casting mold and casting the aluminum-lithium alloy wherein a protective molten salt cover covers the molten aluminum-lithium alloy at least during casting.

According to the present invention there is provided a method for casting aluminum-lithium based alloys which comprises:

(a) forming a molten aluminum-lithium alloy;
(b) transferring said molten aluminum-lithium alloy to a casting mold;
(c) casting said aluminum-lithium alloy; and
(d) maintaining a protective molten salt cover including a lithium salt component over said aluminum-lithium alloy at least during step (c).

A preferred salt flux provided by the present invention comprises a mixture of lithium chloride and at least another salt selected from the group consisting of KCl, NaCl and LiF. The presence of the molten protective salt cover eliminates the need for an inert atmosphere and allows melting, casting, and sampling of the aluminum-lithium alloy in an ambient atmosphere.

The present invention also provides for a method for direct chill casting aluminum-lithium alloys into ingots which comprises providing a thin protective LiCl-KCl molten salt layer on the head of the ingots during casting.

BRIEF DESCRIPTION OF THE DRAWINGS

The present invention will now be described with reference to the accompanying drawings in which.

DESCRIPTION OF THE PREFERRED EMBODIMENTS

Figure 1:
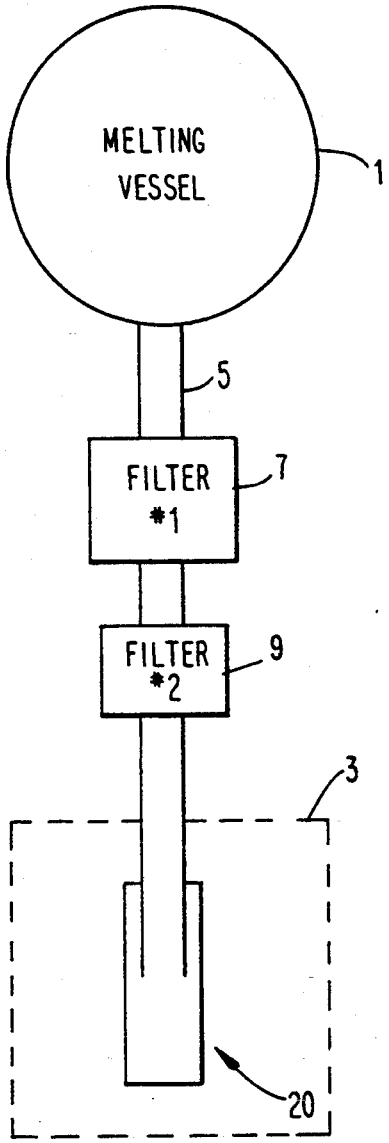
FIG. 1 is a schematic illustration of an apparatus used in one embodiment of the present invention.

The present invention involves-techniques for melting and casting aluminum-lithium alloys under a protective molten salt cover layer. The aluminum-lithium alloy according to the present invention may contain up to 10 weight percent lithium. Moreover, the techhniques of the present invention may be utilized in conjunction with various aluminum-lithium-based alloys which include various alloying materials such as, but not limited to, Si, Fe, Cu, Na, Ag, Mg, Mn, Zn, Zr, Ti, Ni and Cr. Suitable starting materials for melts may include pure metals which are alloyed during the casting process or various alloys which are recovered, remelted and recast from various sources of scrap materials. In this regard, the techniques of the present invention are particularly suitable for casting aluminum-lithium alloy derived from scrap.

The salt mixture utilized as the molten salt protective cover includes LiCl as a component thereof. Preferred salt mixtures include LiCl in combination with other salts selected from KCl, NaCl, and LiF. Selection of salts affects both the percent recovery of lithium and on corrosive effects of the salts on various crucible materials. In the broadest embodiment, the salt mixture comprises about 10 to 65 mole % KCl and about 35 to 90 mole % LiCl, or about 16.4–76.6 wt. % KCl and 23.4–83.6 wt. % LiCl. More preferred salt mixtures include about 60 weight % KCl, about 40 weight % LiCl or about 40 mole KCl and 60 mole % LiCl.

The more preferred salt mixture composition of about 60 weight % KCl and about 40 weight % LiCl is optimum since it is near the eutectic composition which provides the lowest melting temperature. Although the eutectic composition is preferable, the broad range disclosed above provides usable compositions with reasonably low melting temperatures thereby providing maximum fluidity and reasonable raw material cost. It is preferred to utilize salt compositions with a minimum of LiCl content since the LiCl component is the most costly and the most hygroscopic. The presence of the lithium component of the lithium chloride salt on the surface of the metal provides an exchange and/or replacement medium for the highly reactive and mobile lithium atoms in the aluminum-lithium molten metal. The presence of the lithium containing salt cover thereby prevents rapid loss of lithium from the alloy melt.

The salts may be added to the metal melts in either solid or molten form. Preferably, the salts are first melted in a crucible and aluminum-lithium metal is thereafter immersed and melted below the protective cover of molten salt. For convenience, specific salt mixtures may be prepared by melting components together, solidifying the molten salt mixture and grinding the solidified salt mixture. The ground or granulated salt may then be conveniently melted to form a molten salt layer under which aluminum-lithium may be immersed. Otherwise, the ground or granulated salt may be added to a metal charge before or after melting the metal. In preparing the granulated salt as discussed, it is also possible to mix or add other dry granulated or powdered salts together during the grinding process.

The molten salt cover is utilized to protect the molten metal from oxidation by ambient oxygen. Accordingly, the present invention is particularly advantageous in that it eliminates the use of inert atmospheres as are utilized by other conventional melting and/or specialized casting methods.

In another aspect of the invention, lithium may be alloyed to molten aluminum through the protective molten salt cover. In one mode, virgin aluminum is first melted under a molten salt cover and lithium, either in solid form or in a molten state, is then added to the molten aluminum through the protective salt cover to form an aluminum-lithium alloy. The salt may be first melted alone and aluminum immersed thereunder and melted under the molten salt cover. Otherwise, the salt may be added either as a solid before or after the aluminum is melted, or as a solid or melt, after the aluminum has been melted.

The molten aluminum-lithium alloys and aluminum-lithium-based alloys provided with the protective molten salt cover according to the present invention may be cast utilizing any conventional type of casting process including casting in tilt molds, pig molds, direct chill casting, etc. The use of a molten salt protective cover has been found to be particularly useful in direct chill casting processes wherein a salt cover is added to the ingot head in the mold. Techniques according to the present invention, which were particularly designed to eliminate the need of inert atmospheres during alloying and casting, also apply to melting vessels which melt and/or alloy aluminum scrap. The melted aluminum-lithium alloys are transferred through troughs and, optionally, filters to the direct chill casting station. It is believed that utilizing a molten protective salt cover in the melting furnace passivates the aluminum alloy prior to flowing via the trough to the casting station. Although the molten aluminum alloy can be transferred without the salt cover, transfer may be performed with the salt cover, if desired.

When utilizing the molten salt cover in the ingot mold, it has been discovered that a salt cover having a minimum thickness which is sufficient to isolate the molten metal from the atmosphere is advantageous. The thin layer of salts prevents burning or flaring at the ingot head, reduces lithium loss, and retards oxidation.

With reference now to FIG. 1, a melting vessel is schematically depicted as reference numeral 1. The melting vessel is in communication with the casting station 3 of a direct chill casting apparatus via a transfer trough 5. Optionally, the transfer trough may include a pair of filters designated by the references numerals 7 and 9. Filter #1 may be a foam-type plate filter desired for Particulate removal with filter #2 being a ceramic bed filter designed for both particulate removal and degassing of the molten metal passing through the transfer trough 5.

In another aspect of the invention, the base metal charge for the melting vessel 1 may consist of heavy alloy scraps such as heavy gauge plate or ingot scrap. When using heavy alloy scrap, the protective salt cover flux may be added to the melting vessel prior to or at the beginning of incipient melting.

After the base charge is molten and alloyed with non-lithium alloying components, and the protective salt cover is in place, the reactive lithium metal is immersed through the flux cover for alloying with the aluminum base charge.

The alloyed metal may then be fluxed for gas and-particulate removal in the melting vessel. The flux gas may be introduced with either a spinning nozzle degasser or flux wand.

Figure 2:
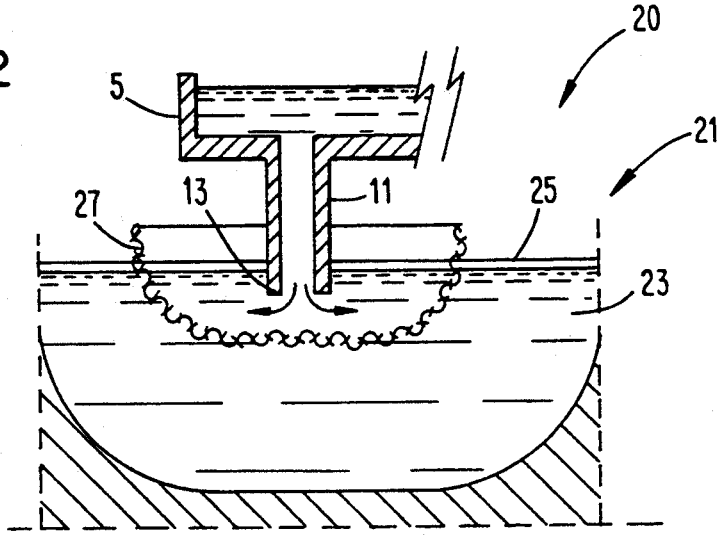
FIG. 2 is a schematic illustration of the casting mold depicted in FIG. 1.

The alloyed aluminum melt is then transferred by the trough 5 to the direct chill casting mold 20. With reference now to FIGS. 1 and 2, the aluminum-lithium alloy in the transfer trough is introduced to the direct chill casting mold 20 via the downspout 11. The terminating end 13 is submerged into the molten metal 23 in the ingot head 21. The protective salt cover flux 25 is introduced to the molten surface of the ingot head 21 as a thin layer.

It should be understood that the terms ingot head, ingot, ingot form and direct chill cast ingot encompass all cast forms capable of being direct chill cast, such as ingots, billets, bars or the like.

In addition to the prevention of burning and loss of lithium resulting from rapid oxidation through contact of the molten aluminum-lithium metal with the ambient atmosphere, the protective salt cover 25 also produces a superior ingot cast surface with reduced surface defects such as laps, tears and drags. This superior quality ingot surface results in reduced scalper scrap and improvements in plate products produced from further hot working of the direct chill cast ingot form.

The protective salt cover flux also provides improvements in consistency of lithium analysis as a result of being able to alloy the lithium with the molten aluminum in the melting vessel using solid ingot lithium shapes. This mode of alloying of the aluminum with the lithium maintains tighter control over the desired lithium concentration, Less variance, and a more consistent lithium analysis as compared to prior art in-line or in-trough molten lithium injection.

With reference again to FIG. 2, the direct chill casting method is preferably conducted using a woven carbon fiber channel bag 27 which is designed to distribute the flow and high temperatures of the molten aluminum-lithium alloy towards the sides or narrow faces of the ingot as indicated by the arrows. The carbon fiber channel bag is preferably constructed of a carbon fiber manufactured by Celion and woven into the fiber channel bag configuration by channel bag manufacturer Textile Products, Inc. However, other readily available carbon fibers may be used as well as other channel bag manufacturers. Use of a carbon fiber channel bag overcomes deficiencies in prior art fiberglass bags which become embrittled and degenerate during aluminum-lithium alloy casting. Embrittlement and degeneration of the bag causes a loss of bag function and addition of unwanted particulate inclusions in the metal casting stream. Optionally, a conventional spout sock may be used in conjunction with the downspout and the channel bag to further distribute the flowing molten metal.

During direct chill casting, it has also been discovered that any tools, skimmers, rakes, ladles, etc., should preferably of a non-ferrous material to provide extended tool life and contribute significantly to the reduction of iron contamination in the molten and subsequently cast ingot and/or billet. Alternative materials include titanium, carbon and/or graphite. Use of non-ferrous tools and components in conjunction with the melting and casting of these types of alloys have resulted in reductions in iron levels as high as 0.5% down to 0.03 to 0.04% by weight.

Since the lithium in the aluminum alloy attacks furnace refractories, it is believed that the lithium-containing salt cover flux will also attack the refractories in contact therewith. Thus, a preferred refractory or lining configuration to reduce refractory consumption in conjunction with casting of these types of alloys is a high-alumina working refractory. These types of high-alumina refractories extend refractory lining life by reducing excessive erosion and cracking of the refractories in direct contact with the aluminum-lithium molten material. Vessel refractory life has been noted as typically one year for about one million pounds of cast material compared to a two week life of carbon or silicon based refractories.

In yet another aspect of the invention, the lithium chloride containing salt flux may be utilized in reclamation of aluminum alloy scrap. In this aspect of the invention, a lithium fluoride salt component is preferably added to the lithium chloride containing salt mixture in weight percentages up to 5 percent. The 5 percent fluoride compound in this mixture disperses the oxides and releases the desired aluminum for reclamation purposes. It is believed that the lithium fluoride functions in the same manner as the fluoride component in 5 percent cryolite standard reclamation salts.

The use of a sodium chloride salt as a component with the lithium chloride in the salt mixture may be preferably used in conjunction with the thin salt layer on the ingot head in an effort to further reduce raw material cost of the salt mixture and further reduce loss from volatilization at the ingot head. Sodium chloride is typically not preferred in the melting vessel since the sodium component thereof has a tendency to exchange with the lithium in the aluminum alloy, thereby adversely affecting the alloy content with sodium as an impurity element therein.

The use of a lithium containing salt component also contributes to improvements in lithium recoveries in reclamation of scrap alloys. As shown in Table 1, salts having lithium chloride, potassium chloride and lithium fluoride showed lithium recoveries in excess of 95 percent. This observed improvement in lithium recovery is believed to also contribute to the improvements in aluminum-lithium alloy casting and reduced lithium losses in the molten metal as a result of the inventive salt flux cover.

TABLE I

Scrap Alloy Composition (wt %)

| Si | Fe | Cu | Mg | Li | Zr | Na | K |
|---|---|---|---|---|---|---|---|
| .04 | .06 | 2.21 | .70 | 2.29 | .11 | .0003 | <.001 |

Salt Used = 55.5 wt %
Kcl - 39.6 wt %
LiCl - 4.9 wt % LiF

Crucible = Commercial Carbon - Bonded SiC

Reclaimed Alloy Composition (wt %)

| Test # | Si | Fe | Cu | Mg | Li | Zr | Na | K |
|---|---|---|---|---|---|---|---|---|
| 1 | .04 | .05 | 2.21 | .68 | 2.26 | .11 | .002 | <.001 |
| 2 | .04 | .05 | 2.18 | .67 | 2.23 | .10 | .002 | |
| 3 | .04 | .05 | 2.19 | .67 | 2.23 | .11 | .001 | |
| 4 | .04 | .05 | 2.21 | .69 | 2.26 | .11 | .001 | <.001 |

Recoveries

| Test # | Metal | Li | Mg |
|---|---|---|---|
| 1 | 98.8 | 97.5 | 96.0 |
| 2 | 98.7 | 96.2 | 94.5 |
| 3 | 99.1 | 96.5 | 94.8 |
| 4 | 99.9 | 98.6 | 98.5 |

Figure 3:
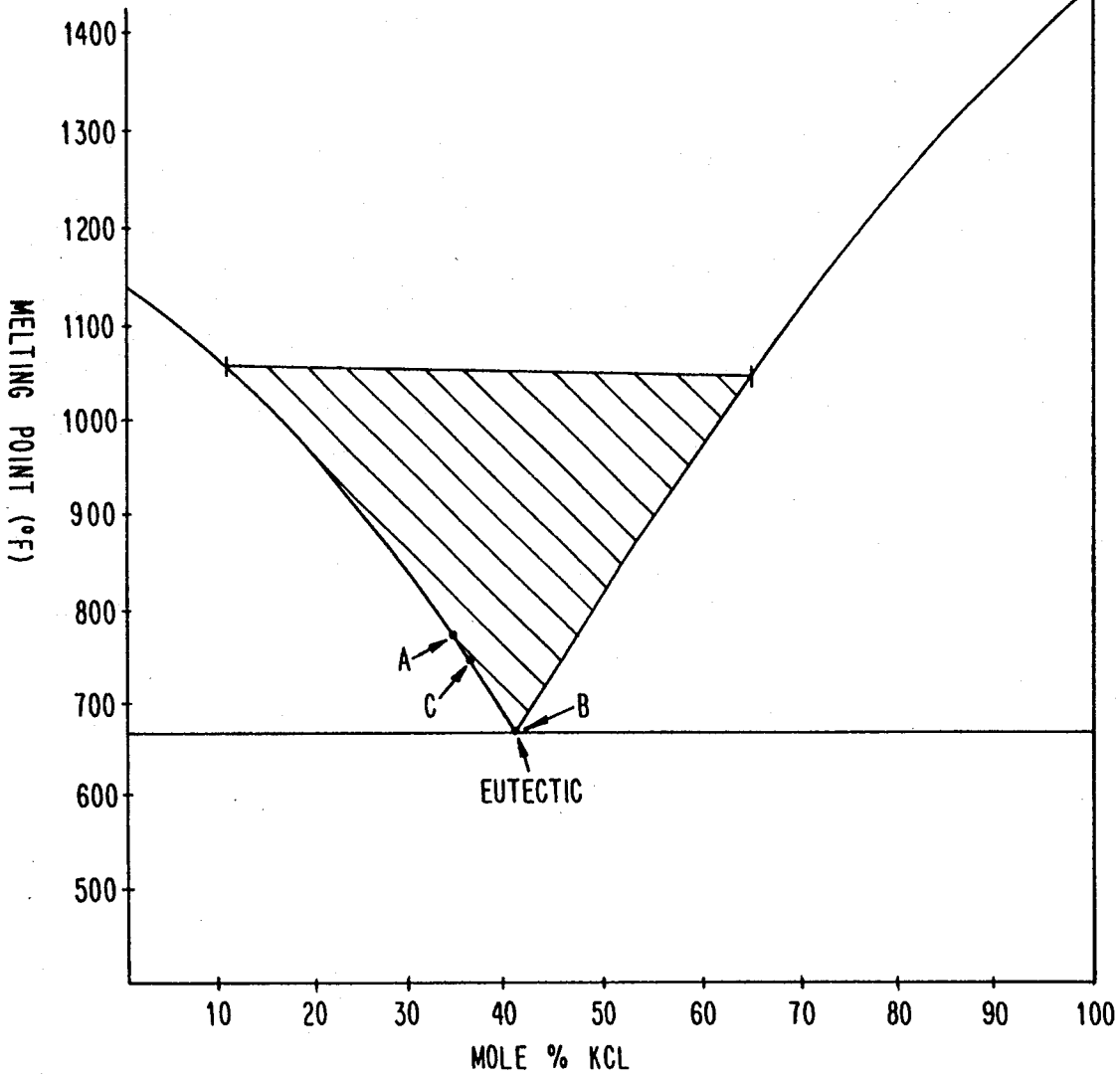
FIG. 3 is a phase diagram for KCl-LiCl showing exemplary salt compositions utilized according to the present invention.

With reference now to FIG. 3, a potassium chloride/-lithium chloride phase diagram is shown. The hatched portion thereof represents the preferred composition of the lithium chloride/potassium chloride salt mixture for use in the inventive process. More preferred compositions are designated as point A, i.e. 34.3 mole % KCl and 65.7 mole % LiCl, point B, the eutectic composition of 42 mole % KCl and 58 mole % LiCl, and point C, 36.2 mole % KCl and 63.8 mole % LiCl. It should be understood that point A equates to about 48.1 weight % KCl and about 52 weight % LiCl or about 50 volume percent KCl and 50 volume percent LiCl. Point B is equivalent to about 56 weight % KCl and 44 weight % LiCl with point C being about 50 weight % KCl and 50 weight % LiCl.

The use of the inventive salt flux cover in aluminum-lithium alloys also results in a plate product obtained from a cast ingot which is essentially free of non-metallic inclusions such as chlorine or potassium components even though the molten salt containing these components is in direct contact with the alloy in the melting vessel and ingot head. Further, plate products derived from the ingots and/or billets cast according to the inventive process show low levels of hydrogen solubility which contribute to a weldable plate product. Since the aluminum-lithium alloy plate products are typically used in aircraft and aerospace applications, low levels of hydrogen in the plate product are essential for adequate welding.

Aluminum-lithium alloy plates produced from direct chill cast billets and/or ingots can exhibit isolated and random occurrences of bursts of welding porosity which is believed to be caused by high levels of hydrogen in the material. It has been discovered that the inventive casting process contributes to a reduction in hydrogen levels in plate product due to the protection afforded by the salt layer. Further reductions in hydrogen levels may be attributed to minimizing or elimination of sampling during casting, in particular, in the transfer through or, using the techniques described above for reducing iron contamination.

The following example is presented to illustrate the invention which is not intended to be considered as being limited thereto. In this example, percentages are by weight unless otherwise indicated.

EXAMPLE 1

In this example, casting experiments using an AA2090 alloy were conducted using a laboratory scale casting station similar to the apparatus illustrated in FIG. 1. The station setup included the installation of a transfer trough with an in-line Selee-Fe filter. The transfer trough was composed of two sections: a filter box and a trough section. The filter box was lined with Plibrico Hymor 3100 castable refractory. It housed a silicon carbide filter frame capable of holding a 9" by 9" tapered ceramic foam filter. The trough section was lined with rigidized Kaowool board and the entire trough was coated with a boron nitride slurry.

A 4"×6", 15 ppi Selee-Fe filter was used. This size filter required a graphite adapter frame to allow the filter to seat in the "cast-in" 9"×9" frame.

Fluxing was achieved through a graphite flux tube with a porous diffuser plug.

The typical charge weight was 375 lb. The alloy minus lithium was prepared in an Ajax induction furnace according to standard foundry practice. After the last non-lithium alloy addition (such as Mg), the salt cover flux was added on top of the molten metal in the furnace. For a virgin charge, the salt composition was 50% KCl, 50% LiCl and was added in a molten or "dry" form. 4 lbs of the salt mixture was added before the lithium addition to provide a cover approximately ¼" thick. The lithium was added in its solid ingot form when the base melt temperature approximated 727° C.

After the lithium addition, the melt was fluxed with argon. Once the fluxing was completed, the melt was skimmed and a grain refiner was added. Analytical buttons were then taken for chemical analysis. After a final stirring and skimming, the metal temperature was brought up to 743° C. for pouring. It should be noted that a thin molten salt layer was maintained over the melt at all times.

Prior to the cast, the trough and Selee filter were thoroughly preheated. When the cast was initiated and the metal started to fill the mold, the molten salt flux (50% KCl, 50% LiCl) was ladled into the ingot head as soon as possible. The drop speed was engaged when the metal level reached a specified value.

For the first two casting attempts of AA2090 alloy, no salt was added to the ingot head during the cast. Without a salt cover in the ingot head, considerable oxidation of the molten metal in the mold was noted. Even with a continuous lubrication system on the mold, hot tears and bleed-outs were experienced. On the third attempt to cast the alloy, molten salt was ladled onto the ingot head approximately 18" into the drop. A great improvement in the ingot surface quality was noted as well as reduced oxidation in the ingot head. It appeared as though the molten salt cover not only reduced oxidation but served as a casting lubricant. On this (third) attempt, the ingot produced exhibited an acceptable surface and possessed no cracks.

Subsequently, eight AA2090 alloy ingots were successfully cast. A list of general casting practice information is presented in Table II.

TABLE II

Typical Casting Practice Information for AA2090 Alloy 8×17 D.C. Mold

STATION SETUP INFORMATION

Bottom Block Starting Position—0.75 in.
Degree of Underpour—0.75 in.
Spout Sock: Small spout sock w/2×3 patch and ends cut (−1" opening) for increased flow
MOLD/BLOCK PREPARATION: Mold and bottom block coated with mold grease. Single fiberglass cloth butt patch
MOLD LUBRICANT: Sunflex 150 mineral oil (535 SVE Viscosity)

CASTING PRACTICE INFORMATION

Furnace Pour Temperature—743° C.
Initial Plug Opening—100%
Water Flow Rate—28 gpm
Starting Drop Speed—2.50 in/min
Steady State Speed—3.25 in/min
Metal Level in Mold—3.0 in.
Grain Refiner: 0.02% 5/0.2 TiB rod Although the invention has been described with reference to particular means, materials and embodiments, from the foregoing description, one skilled in the art can ascertain the essential characteristics of the present invention and various changes and modifications may be made to adapt the various uses and characteristics thereof without departing from the spirit and the scope of the present invention as described in claims that follow.

What is claimed is:

1. A method for casting aluminum-lithium based alloys which comprises:
(a) forming a protective molten salt cover comprising a lithium chloride containing salt composition in a furnace containing molten aluminum alloy;
(b) adding at least one of lithium and a lithium-containing aluminum alloy to he molten aluminum alloy through the salt cover to form a molten aluminum lithium alloy in the furnace;
(c) transferring said molten aluminum-lithium alloy to a casting station; and
(d) casting said molten aluminum-lithium alloy into an ingot form.

2. The method for casting aluminum-lithium based alloys according to claim 1, wherein said step (c) comprises direct chill casting.

3. The method for casting aluminum-lithium based alloys according to claim 2, further comprising maintaining a protective molten salt cover over said aluminum-lithium alloy during said casting step, said protective molten salt cover comprising a lithium chloride containing salt composition, said molten salt cover being maintained as a layer covering an ingot head formed during said direct chill casting.

4. The method for casting aluminum-lithium based alloys according to claim 3, wherein said layer is of sufficient thickness on said ingot head to prevent burning and flaring of said ingot head.

5. The method for casting aluminum-lithium based alloys according to claim 1, wherein step (c) comprises transferring said molten aluminum-lithium alloy by means of an open trough wherein said molten aluminum-lithium alloy in said trough is exposed to atmosphere.

6. The method for casting aluminum-lithium based alloys according to claim 1, wherein said salt cover composition further comprises a mixture of LiCl and at least another salt selected from the group consisting of KCl and LiF.

7. The method for casting aluminum-lithium based alloys according to claim 1, wherein said salt cover composition comprises about 35 to 90 mole % LiCl and 10 to 65 mole % KCl.

8. The method for casting aluminum-lithium based alloys according to claim 7, wherein said salt cover composition comprises about 50 to 70 mole % LiCl and about 30–50 mole % KCl.

9. The method for casting aluminum-lithium based alloys according to claim 7, wherein said salt cover composition comprises about 42 mole % KCl and 58 mole % LiCl.

10. A method for casting aluminum-lithium based alloys according to claim 1, wherein said salt is added in step (a) as a granulated solid and thereafter melted in step (a).

11. A method for casting aluminum-lithium based alloys according to claim 10, wherein said granulated solid salt is formed by mixing two or more salts in molten form, solidifying said salt mixture, and grinding said solidified salt mixture to form said granulated solid salt.

12. A method for casting aluminum-lithium based alloys according to claim 1, wherein, said molten aluminum-lithium alloy is formed by melting and recycling aluminum-lithium scrap.

13. A method for casting aluminum-lithium based alloys according to claim 1, wherein said aluminum-lithium alloy comprises up to 3% by weight lithium.

14. A method for casting an aluminum-lithium based alloy into an ingot which comprises;

(a) forming a molten aluminum-lithium alloy to be cast in a furnace under a first protective molten salt layer;

(b) transferring the molten aluminum-lithium alloy to be cast from the furnace to a casting station;

(c) providing a second protective molten salt layer at the casting station on a head of an ingot during casting, each of said first and said second salt layers in the furnace and in the casting station having a lithium chloride containing salt composition; and (d) casting said aluminum-lithium based alloy into an ingot form.

15. A method for casting an aluminum base alloy into an ingot according to claim 14, wherein said second molten salt layer is provided during a period in which molten aluminum-lithium is being poured into an ingot mold.

16. A method for casting an aluminum-lithium based alloy into an ingot according to claim 1, wherein each of said first and said second salt composition comprises a mixture of LiCl and at least another salt selected from the group consisting of KCl, LiF and NaCl.

17. The method for casting an aluminum-lithium based alloy into an ingot according to claim 15, wherein said first salt composition comprises about 35 to 90 mole % LiCl and 10 to 65 mole % KCl.

18. The method for casting an aluminum-lithium based alloy into an ingot according to claim 15, wherein said second salt composition comprises about 50 to 70 mole % LiCl and 30–50 mole % KCl.

* * * * *